United States Patent [19]

Riaboff

[11] Patent Number: 4,532,653

[45] Date of Patent: Aug. 6, 1985

[54] BASEBALL GLOVE

[76] Inventor: Peter Riaboff, 403 25th Ave., San Francisco, Calif. 94121

[21] Appl. No.: 581,861

[22] Filed: Feb. 21, 1984

[51] Int. Cl.[3] ..... A41D 13/10; A41D 19/02

[52] U.S. Cl. ..... 2/19; 2/159; 2/161 A; 2/169

[58] Field of Search ..... 2/19, 20, 158, 159, 2/161 A, 161 R, 167, 169

[56] References Cited

U.S. PATENT DOCUMENTS 3,602,915 9/1971 Collins ..... 2/19

4,071,921 2/1978 Jury ..... 2/158 X

*Primary Examiner*—Werner H. Schroeder

*Assistant Examiner*—Judith L. Kravitz

*Attorney, Agent, or Firm*—Hamrick, Hoffman Guillot & Kazubowski

[57] ABSTRACT

The method of fabricating a baseball glove from a single sheet of paperboard, and the resulting baseball glove.

14 Claims, 8 Drawing Figures

BASEBALL GLOVE

(1.) BACKGROUND OF THE INVENTION

This invention relates to baseball gloves and methods of fabricating baseball gloves.

(2.) DESCRIPTION OF PRIOR ART

Approximately twenty patents have been issued relating to baseball gloves and the construction thereof. An early patent, U.S. Pat. No. 787,480 granted to Bennett, discloses a pair of gloves, one to be worn on each hand, tied together by a web of cloth of fabric in which the ball is to be caught.

Subsequent patents often describe and claim methods of stitching or otherwise holding the component parts of the glove together. Examples are U.S. Pat. No. 832,430 granted to Stall, U.S. Pat. No. 1,542,516 granted to Dankert, U.S. Pat. No. 1,631,735 granted to Kennedy et al, U.S. Pat. No. 1,714,648 granted to Walker, U.S. Pat. No. 2,485,882 granted to Hilton, U.S. Pat. No. 3,377,627 granted to Madnick, and U.S. Pat. No. 4,227,263 granted to Zidela. Additionally, at least two design patents have been issued on baseball gloves, Des. No. 225,044 granted to Bates and Des. No. 264,517 granted to Zedela.

U.S. Pat. No. 1,817,385, granted to Marks for a hand covering, discloses the use of an oiled paper for the front or palm portion of the hand covering so that greasy or eleaginous matter will not penetrate through the palm portion. However, the hand covering itself is a simple mitten that is unsuitable for catching and holding thrown objects such as baseballs.

U.S. Pat. No. 2,142,788, issued to Jensen, describes a one-piece protective mitten that wraps most of the way around the main portion of the hand and provides a separate, fully enclosed extension for the thumb. The hand protector is held against the hand by a simple strap across the back of the hand. This apparatus is not suitable for use as a baseball glove.

Another hand protector disclosed in U.S. Pat. No. 2,673,348, granted to DuChene, describes a mitten containing separate extensions to receive the thumb and the fingers of the wearer's hand. This apparatus is unsuitable for one-piece construction and for use as a baseball glove.

A baseball glove suitable for catching momentarily, and then throwing, a baseball using the gloved hand, is disclosed in U.S. Pat. No. 2,798,223 granted to Smith. The glove has a number of flaps or ball-engaging edges positioned adjacent to the circumference of the glove (in plan view). The main portion of the glove is of one-piece construction. Such construction is unsuitable if the glove is to be made of ridged materials as the flaps would be too stiff and would not engage and capture a ball.

Hudson, in U.S. Pat. No. 3,065,813, discloses a single-piece construction in which a conventional baseball glove is provided with a long strap, which is a part of the glove itself, that wraps around the wrist of wearer for holding the glove in place.

U.S. Pat. No. 4,279,681, granted to Klimezky, discloses the use of a unitary, molded resilient plastic shell to be used as the front portion of a baseball glove. This glove can not be formed from a single planar sheet of material, and it appears to have conventionally formed fingers for the wearer's hand.

SUMMARY OF THE INVENTION

It is an object of the invention to provide a paperboard baseball glove that is easily fabricated from or defabricated to single, planar paperboard cutout.

It is another object of the invention to provide a paperboard baseball glove that is simultaneously usable on the right hand or left hand of the wearer.

Other objects and novel features of the subject invention, and advantages thereof, will become clear by reference to the detailed description and the accompanying drawings.

In the preferred embodiment, the subject invention is a method of fabricating a baseball glove from a planar sheet of paperboard of generally ovular shape of maximum diameter at least 10 inches. The method may include the steps making a first fold line along a diameter line of the oval, with the diameter line defining right and left half ovals and right and left circumferences; making a first cut along the diameter line from the circumference inward a distance of about 45 percent of the length of the diameter line to a first cut point in the interior of the oval; making a second cut along the diameter line from a second termination point of the diameter on the circumference inward for substantially 40 percent of the length of the diameter to a second cut point; making a second fold line along a line lying in the left half oval that is parallel to the diameter and spaced apart from the diameter by a distance of substantially 3 cm., with the length of the second fold line being substantially 55 percent of the length of the first fold line, with one end of the second fold line terminating on the left half circumference at a point adjacent to, but spaced apart substantially 3 cm. from, the second termination point of the first fold line and the other end of the second fold line terminating in the left half oval at a fourth cut point; making a third cut along the second fold line from the left half circumference to a third cut point, where the length of this third cut line is substantially equal to the length of the second cut line; making a third fold line from the fourth cut point to the left circumference along a line oriented at a first angle $\theta_1 \approx 170$ degrees away from the second fold line; making a fourth cut along the third fold line from the fourth cut point to the left half circumference; making a fourth fold line from the fourth cut point to the left circumference along a line oriented at a second angle $\theta_2 \approx 18$ degrees away from the third fold line; making a fifth fold line from the third cut point to the left half circumference along a line oriented at a third angle $\theta_3 \approx 10$ degrees away from the second fold line; making a sixth fold line from the second cut point to the right circumference along a line oriented at a fourth angle $\theta_4 \approx 13$ degrees away from the second cut line; making a seventh fold line from the first cut point to the right half circumference along a line oriented at a fifth angle $\theta_5 \approx 32$ degrees away from the first cut line; making an eighth fold line in the right half oval, beginning on the right half circumference and terminating on the first cut line, with the eighth fold line being oriented at a sixth angle $\theta_6 = (180 \text{ degree} - \theta_1)$ away from the seventh fold line, where the eighth fold line terminates on the right half circumference at a point that is substantially the same distance from the right half circumference termination point of the seventh fold line as is the distance of the left half circumference termination points of the first cut line and fourth cut line from the first cut point to the fourth cut point; and making a tenth fold line from the second cut point to the third cut point.

Upon folding the planar paperboard sheet, a baseball glove is formed which, in the preferred embodiment, includes a first planar rectangular element substantially three cm. in width and substantially six cm. in length; a second planar element, contiguous with and attached to one of the long sides of the first planar element, with the plane of the second planar element intersecting the plane of the first planar element at a first angle $\phi_1 \geqq 25$ degrees; a third planar element, contiguous with and attached to the second of the long sides of the first planar element, with the plane of the third planar element intersecting the plane of the first planar element at a second angle $\phi_2 \geqq 25$ degrees; a fourth planar element of trapezoidal shape, contiguous with and attached to one of the short sides of the first planar element, with the plane of the fourth planar element intersecting the plane of the first planar element at a third angle $\phi_3 \geqq 25$ degrees, with the second planar element intersecting and being attached to the fourth planar element along a common edge, and with the third planar element intersecting and being attached to the fourth planar element along a common edge; and a fifth planar element of trapezoidal shape, contiguous with and attached to the second short side of the first planar element, with the plane of the fifth planar element intersecting the plane of the first planar element at a fourth angle $\phi_4 \geqq 10$ degrees, with the second planar element intersecting and being attached to the fifth planar element along a common edge, and with the third planar element intersecting and being attached to the fifth planar element along a common edge.

DESCRIPTION OF THE INVENTION

The subject invention is a baseball glove, formed from a single sheet of paperboard or similar material that is preferably at least 2 mm thick, which may be easily assembled for use or disassembled for storage. Before describing the invention itself, it is appropriate to introduce several definitions that will be used in the description, summary and claims.

An "oval" is a generally convex planar figure that may resemble a circle, an ellipse, a convex linear or curvilinear polygon or other similar (strictly) convex figures. The figure need not be symmetric, and the requirement can be relaxed to include figures that have a few cusps or scallops on their perimeters.

Figure 1:
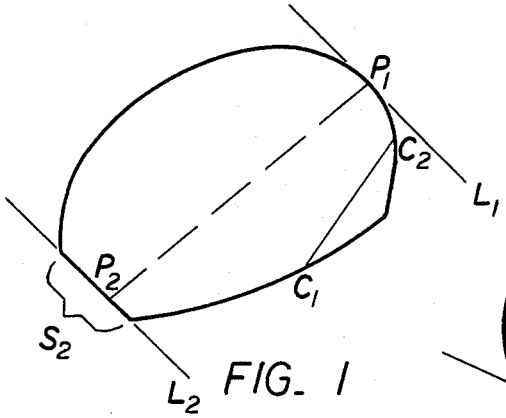
FIG. 1 shows a representative (convex) "oval" and a representative "diameter line", and the resulting "left half oval," "right half oval," "left half circumference" and "right half circumference", as defined in the detailed description.

With reference to FIG. 1, which shows a representative (convex) oval, each direction in the plane of the oval defines a family of parallel lines that are parallel to that direction; and for each such direction one can find a unique pair of parallel lines ($L_1$ and $L_2$ in FIG. 1) in the associated family of parallel lines such that each of this pair of lines intersects the circumference or perimeter of the oval at least once and all circumference and interior points comprising the oval lie on or between the two parallel lines. If the oval is convex, as shown in FIG. 1, the collection of intersection points of each of $L_1$ and $L_2$ with the oval circumference is either a single point ($P_1$ on $L_1$) or is a connected continuum of points (the segment $S_2$ on $L_2$), where a portion of $L_2$ coincides with a linear segment that comprises part of the circumference of the oval. If the oval is not strictly convex but has a cusps as illustrated in FIG. 2, a given line, $L_1'$, of a parallel pair of lines $L_1'$ and $L_2'$ may intersect the oval at two or more isolated points or collections of points ($P_1'$ and $P_1''$ in FIG. 2) for which some or all of the points on $L_1$ lying between $P_1'$ and $P_1''$ are not part of the oval.

Returning to FIG. 1, each pair of points $P_1$ and $P_2$ defines a line segment $P_1 P_2$ that is called a "diameter line" herein. All points of the circumference of the oval and lying to the left (alternatively, right) of the line segment $P_1 P_2$ are called, collectively, the "left half circumference" (alternatively, "right half circumference") of the oval. All points in the interior of the oval (not including any points on the oval circumference) lying to the left (alternatively, right) of the line segment $P_1 P_2$ are called, collectively, the "left half oval" (alternatively, "right half oval").

A "chord" on an oval, is any line segment ($C_1 C_2$ in FIG. 1) that terminates on two distinct points on the circumference of the oval and contains a least one interior point of the oval.

Figure 2:
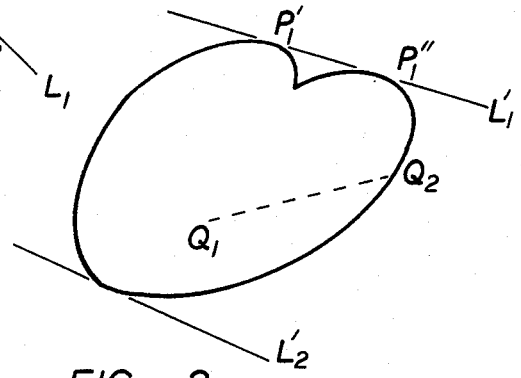
FIG. 2 shows a representative (not necessarily convex) oval and a representative "fold line" thereon.

"Making a fold line" on an oval such as the line segment $Q_1Q_2$ in FIG. 2 shall mean (indicated by a solid or dotted or other intermittent line drawn between $Q_1$ and $Q_2$) that the figure is to be folded along $Q_1Q_2$; this shall include the alternative of actually folding the figure along $Q_1Q_2$ in lieu of providing a solid or intermittent line segment.

"Making a cut" on an oval such as the line segment $Q_1Q_2$ on FIG. 2 shall mean (indicated by a particular solid or dotted or other intermittent line drawn between $Q_1$ and $Q_2$, or by language appearing on a planar face of the figure) that a cut is to be made on the figure between $Q_1$ and $Q_2$; this shall include actually cutting the figure along $Q_1$ and $Q_2$ in lieu of providing a solid or intermittent line segment between $Q_1$ and $Q_2$ or providing appropriate language indicating that such a cut is to be made.

Figure 3:
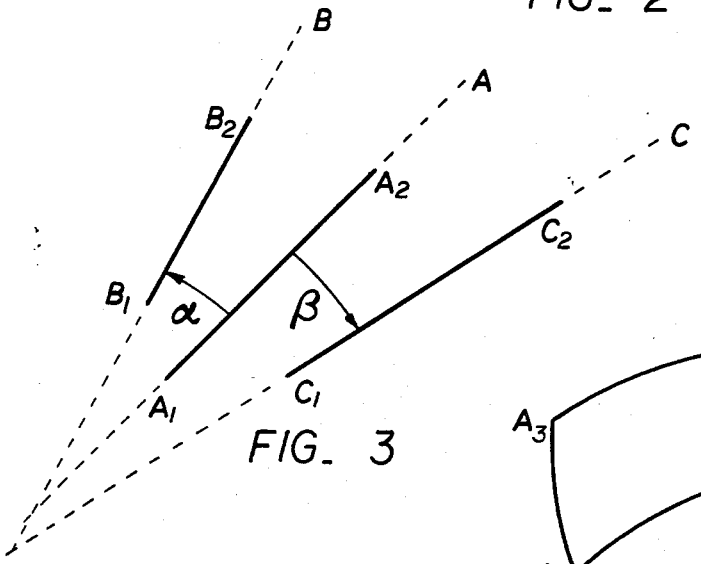
FIG. 3 illustrates the concept of one line on a plane being oriented at an angle $\alpha$(or $\beta$) "away from" a second line in the plane.

Given a line segment, $A_1A_2$ lying on a line A in a plane, a second line segment $B_1B_2$ lying on a line B in the plane is said to be oriented "leftward" at an angle $\alpha$ "away from" the segment $A_1A_2$ if line B intersects line A at the (acute) angle $\alpha$ in the plane as shown in FIG. 3. Similarly, the line segment $C_1C_2$ lying on a line C in the plane is said to be oriented "rightward" at an angle $\beta$ away from the segment if A and C are positioned as shown in FIG. 3.

Figure 4:
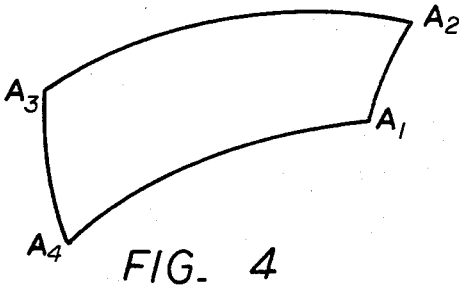
FIG. 4 illustrates a planar element that is a "sector of generally annular shape", comprising four or more curvilinear boundary segments, as defined in the detailed description.

A closed planar curvilinear figure having four or more sides, as in FIG. 4, is called a "curvilinear polygon" if each side thereof ($A_1A_2$, $A_2A_3$, $A_3A_4$ and $A_4A_1$ in FIG. 4) is a curvilinear segment (which may be a linear segment).

Figure 5:
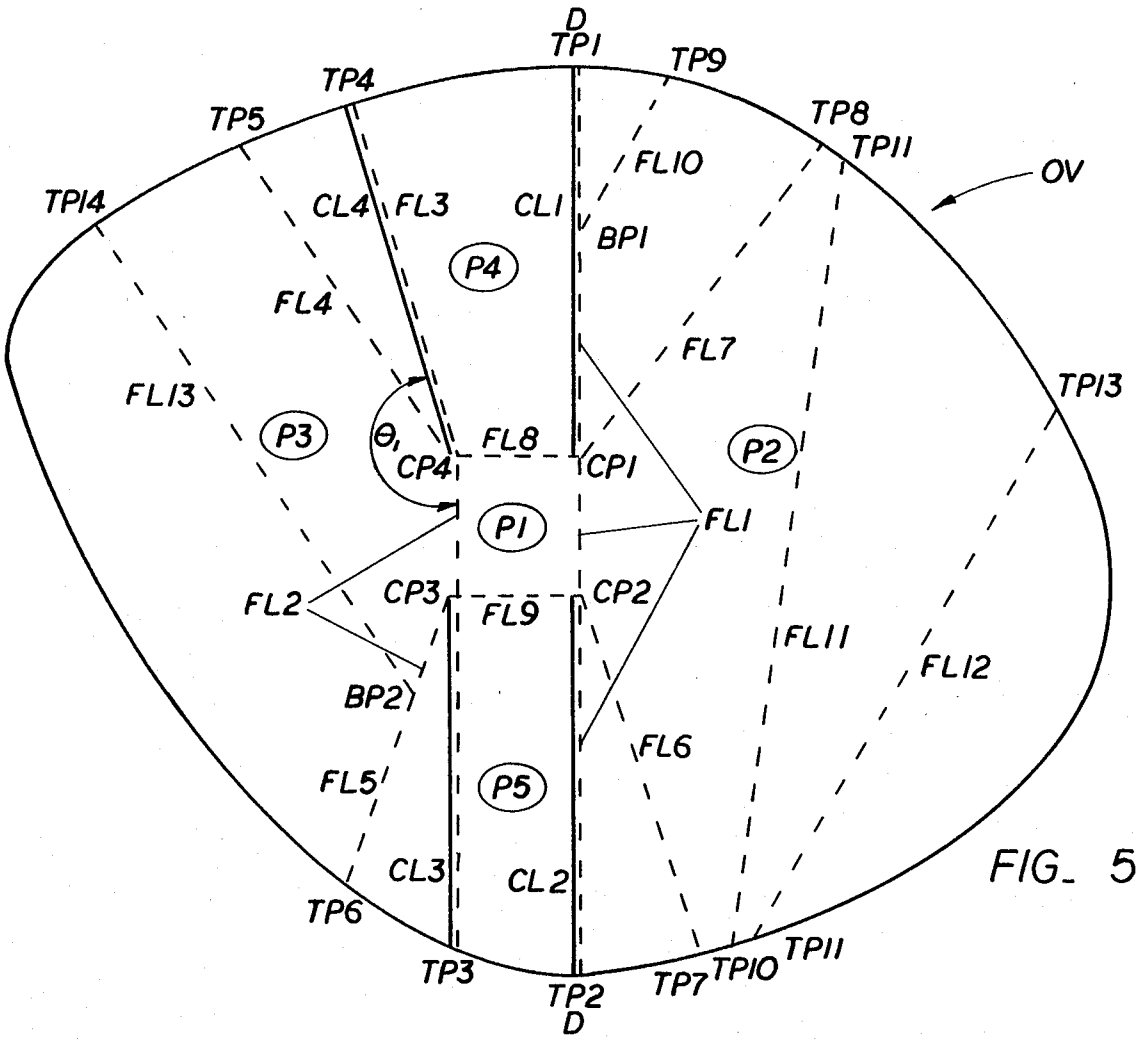
FIG. 5 is a plan view of one embodiment of the subject invention, indicating the fold lines and cut lines that define the invention in one embodiment.

To fabricate the baseball glove, one begins with a planar sheet of paperboard or other similar material having modest stiffness and being 1–6 mm. thick (hereinafter, simply called "paperboard") of ovular shape (FIG. 5). The oval, OV, should preferably be at least 25 cm. in length along a diameter. Choose a diameter line DD on the oval and make a first fold line FL1 along the length of this line, thus defining a left half oval, LHO, and a right half oval, RHO, as shown. The left half oval is the set of all points of the oval lying on one side of DD (the "left" side), not including any point on DD and not including any point on the perimeter or circumference, C, of the oval; the right half oval is analogously defined. The diameter DD naturally divides the perimeter into a left half circumference, LHC, and a right half circumference, RHC, with the left (right) half circumference being all points on the oval perimeter lying to the left (right) of DD not including any point on DD.

One makes a first cut along DD from one termination point TP1 of DD on C toward the interior of OV for a distance of substantially 45 percent of the length of DD to a first cut point, CP, with this cut defining a first cut line, CL1, as shown. One makes a second cut along DD from the second termination point, TP2, of DD on C toward the interior of OV for a distance of substantially 40 percent of the length of DD to a second cut point, CP2, with this cut defining a second cut line, CL2. The respective percentages 45 percent and 40 percent are not critical but are chosen to leave a small portion (10–25 percent) of the first fold line FL1 uncut to hold the two oval halves together and, further, to allow formation of a "pocket" to receive the ball when the glove is fully assembled.

One now makes a second fold line, FL2, along a line lying on the left half oval that is substantially parallel to DD and spaced apart from DD by substantially three cm. (2–6 cm is acceptable), with the fold line preceeding from a point, TP3, on adjacent to TP2 to a point, CP4, in LHO (the fourth cut point) and the length of the second fold line being substantially 55 percent of the total length of the first fold line (the distance from TP1 and TP2). Now one makes a cut along FL2, beginning at TP3 and proceeding inward to a third cut point, CP3, thus defining a third cut line, CL3, whose length is substantially equal to the length of the second cut line CL2.

Beginning at the fourth cut point, CP4, one now makes a third fold line, FL3, from CP4 to a termination point, TP4, on LHC along a line oriented rightward at a first angle $\theta_1 \approx 170$ degrees away from the second fold line as shown in FIG. 5. One then makes a cut along substantially the full length of FL3, thus defining a fourth cut line, CL4.

One now makes a fourth fold line, FL4, from CP4 to a termination point, TP5, on LHC along a line oriented leftward at a second angle $\theta_2 \approx 18$ degrees away from the third fold line.

Beginning at the third cut point CP3, one now makes a fifth fold line, FL5, from CP3 to a termination point, TP6, on LHC along a line oriented rightward at a third angle $\theta_3 \approx 10$ degrees away from the second fold line.

Moving to the right half oval RHO, one now makes a sixth fold line, FL6, from CP2 to a termination point, TP7, on RHC along a line oriented at a fourth angle $\theta_4 \approx 13$ degrees away from the second cut line.

One then makes a seventh fold line, FL7, in RHO from CP1 to a termination, TP8, on RHC along a line oriented rightward at a fifth angle $\theta_5 \approx 32$ degrees away from the first cut line.

Finally, one makes an eighth fold line, FL8, from CP1 to CP4 and a ninth fold line, FL9, from CP2 to CP3. This completes the method for fabricating the baseball glove from a sheet of paperboard.

One may, optionally, add additional fold lines to better define the glove. A tenth fold line, FL10, is now laid down beginning at a termination point, TP9, that lies betwen TP1 and TP8 on RHC and ending at a point, BP1, on CL1, where the distance from TP8 to TP9 is substantially the same as the distance from TP1 to TP4. Beginning at TP9, the tenth fold line FL10 moves toward the seventh fold line FL7 (which begins at TP8) at a small angle $\theta_6 = (180 \text{ degrees} - \theta_1)$. This allows FL10 to substantially coincide with a portion of CL4 when the paperboard is cut and folded so that FL7 coincides with all or a portion of CL1 as described below.

One may add an eleventh fold line, FL11, along a chord in RHO, beginning at a termination point, TP10, on RHC adjacent to TP7 and ending at a termination point, TP11, adjacent to TP8, where FL11 does not intersect FL6 or FL7.

One may, optionally, add a twelfth fold line, FL12, along a cord in RHO that begins at one termination point, TP12, on RHC adjacent to TP10 and ends on another termination point, TP13, lying on RHC between TP12 and TP11, where FL12 does not intersect FL11.

One may, optionally, add a thirteenth fold line, FL13, along a line in LHO that is substantially parallel to FL4, beginning at an arbitrary point, BP2, on FL5 and ending at a termination point, TP14, on LHC. Additional fold lines on RHO and/or LHO may also be included but are not shown here.

One may also fabricate the mirror image of the baseball glove by interchanging the right half and left half oval and circumference prescriptions, including fold lines, cut lines, termination points, orientation angles, etc. The baseball glove, as fabricated, is suitable for use on the right hand or on the left hand of the wearer.

The baseball glove as shown in FIG. 5 is now put together for use in the following manner. Cut the paperboard (if this has not already been done) along the cut lines CL1, CL2, CL3 and CL4. Fold the paper board upward along the fold line FL9 so that the plane of the substantially trapezoidal-shaped planar element or "flap", P4, makes an angle $\phi_3 \geqq 25$ degrees with the plane of the rectangular-shaped planar element P1, as shown in FIG. 6.

Figure 6:
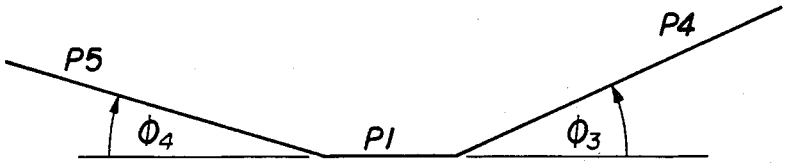
FIG. 6 is a schematic side view of the subject invention when viewed perpendicular to a long side of the first planar element that forms part of the invention.

Now fold the paperboard upward along the fold line FL10 so that the plane of the substantially rectangular-shaped planar element or "flap", P5, makes an angle $\Phi_4 \geqq 10$ degrees with the plane of P1, as shown in FIG. 6.

Figure 7:
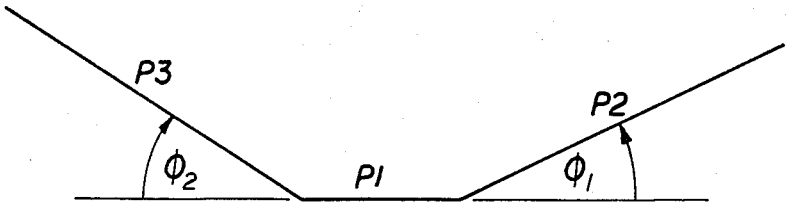
FIG. 7 is a schematic side view of the subject invention when viewed perpendicular to a short side of the first planar element.

Now fold the paperboard upward along the fold line FL1 and position P4 so that the cut line CL1 sustantially coincides with the fold line FL7 along their common length. In this position, the planar element P2, which comprises the right half oval RHO and the right half circumference RHC, will now intersect the plane of P1 at an angle $\phi_1$24 25 degrees as shown in FIG. 7. One can now fold the paperboard along the fold line FL 8 so that FL8 substantially coincides with a portion of the cut line CL4. In this position, TP8 will substantially coincide with TP1 and TP9 will substantially coincide with TP4. Now attach the quadrilateral of paperboard defined by CP1, TP8, TP9 and BP1 to P4 (by a staple, a paperclip, glue or whatever).

Next, position P5 so that the cut line CL2 and the fold line FL6 substantially coincide a long their common length and attach the triangle of a paperboard defined by CP2, TP2 and TP7 to P5.

Now fold the paperboard upward along the fold line FL2 and position P4 and P5 so that the cut line CL3 substantially coincides with the fold line FL5 along their common length and the cut line CL4 substantially coincides with the fold line FL4 along their common length. In this position, the planar element P3, which comprises all points on LHO and LHC lying to the left of FL2 and FL3, will now intersect the plane of P1 at an angle $\Phi_2 \geqq 25$ degrees, as shown in FIG. 7. One now folds the paperboard along FL5 and attaches the triangle defined by CP3, TP3 and TP6 to P5; and one folds the paperboard along FL4 and attaches the triangle defined by CP4, TP5 and TP4 to P4.

The basic baseball glove is now ready for use and comprises five planes of paperboard, P1, P2, P3, P4 and P5, as indicated in FIGS. 6 and 7. These five planes define a "pocket" that can catch an hold a baseball or other substantially spherical object of similar size. The size of the rectangle defined by CP1, CP2, CP3 and CP4 (the first planar element P1) will control the size of the "pocket". One may enlarge this quadrilateral, and thus the "pocket" size, to make the glove suitable for catching and holding larger objects. The most appropriate size of oval OV for a baseball is one that is approximately 27–30 cm. across.

Alternatively, one may describe the subject invention as a collection of five planar elements of paperboard, P1, P2, P3, P4 and P5, individually constructed and attached together as described above.

Figure 8:
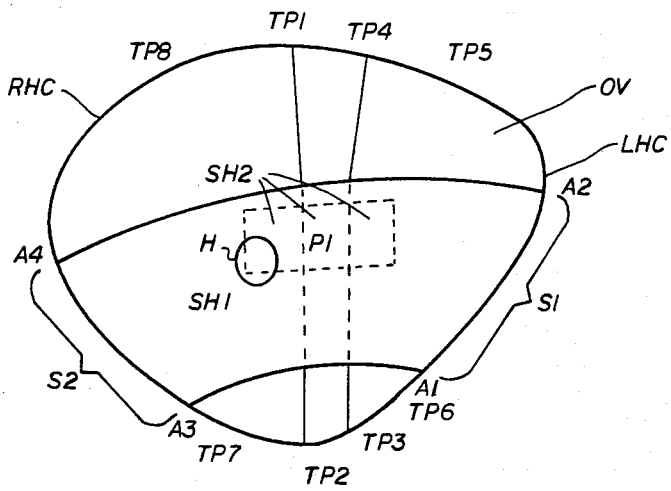
FIG. 8 is a plan view of the reverse side of the embodiment shown in FIG. 5, with the sheet of reinforcing material in place.

As a further improvement, one may introduce a separate sheet, as shown in FIG. 8, of flexible reinforcing material, attached to the back side of the glove to define and enclosure in combination with the backside of the formed glove for receiving the player's hand, thus enhancing the efficient use and manipulation of the glove. FIG. 8 shows the backside of the paperboard oval fabricated according to the subject invention. One attaches a sheet, SH1, of reinforcing material, shaped as a sector of generally annular shape, to the back of the oval OV along the left half circumference LHC from a point, A1, adjacent to the TP6 to a point, A2, lying on LHC between TP5 and TP6, along one sector border, S1, of the sheet. On then attaches another sector border S2, of the sheet to OV along the right half circumference RHC from a point, A3, adjacent to TP7 to a point A4 lying on RHC between TP7 and TP8. The sheet SH1 should preferably be attached so that it does not interfere with or prevent returning the OV figure to its "flattened" or planar condition for storage. The sheet SH1 may be attached to the oval by staples, glue or other suitable means. A hole H may be cut through the Sheet SH1, through which a player may poke his index finger to provide an additional degree of controlability to the formed glove.

A second sheet, SH2, of reinforcing material of generally quadrilateral shape may be attached directly to the back of the planar element P1 as shown in FIG. 8 to reinforce and hold together the two halves of the oval that are held together by the uncut fold line running from CP1 to CP2.

Although the preferred embodiments of the invention have been shown and described herein for purposes of illustration, variation and modification may be made without deporting from the scope of the invention.

I claim:

1. A method of making a paperboard sheet foldable to form a cavity for catching a baseball from a sheet of paperboard, the method comprising the steps of:

cutting a generally ovular blank having a maximum diameter of at least 25 cm. from the sheet of paperboard;

making a first fold line along a diameter line across the ovular blank, with the diameter line thus defining a left half oval, a right half oval, a left half circumference and right half circumference;

making a first cut along the diameter line from it's first termination point on the circumference of the blank inward for a length of substantially 45% of the length of the diameter ine to a first cut point, with this cut defining a first cut line;

making a second cut along the diameter line from it's second termination point on the circumference of the blank inward for a length of substantially 40% of the length of the diameter line to a second cut point, with this cut defining a second cut line;

making a second fold line along a line lying in the left half oval and being parallel to the diameter line and spaced apart from the diameter line by substantially 3 cm., with the length of the second fold line being substantially 55% of the length of the first fold line, with one end of the second fold line terminating on the left half circumference at a point adjacent to, but spaced apart substantially 3 cm. from the second termination point of the first fold line, and the other end of the second fold line terminating in the left half oval at a fourth cut point;

making a third cut along the second fold line from its termination point on the left half circumference to a third cut point, with this cut defining a third cut line where the length of the third cut line is substantially equal to the length of the second cut line;

making a third fold line from the fourth cut point to the left half circumference along a line oriented rightward a first angle ($\theta_1$), of substantially 170° away from the second fold line;

making a fourth cut along the third fold line from the fourth cut point to the left half circumference; thus defining a fourth cut line making a fourth fold line from the fourth cut point to a termination point on the left half circumference along a line oriented leftward at a second angle ($\theta_2$) of substantially 18° away from the third fold line;

making a fifth fold line from the third cut point to a termination point on the left half circumference along a line oriented rightward at a third angle ($\theta_3$) of substantially 10° away from the second fold line;

making a sixth fold line from the second cut point to a termination point on the right half circumference along a line oriented leftward at a fourth angle ($\theta_4$) of substantially 13° away from the second cut line;

making a seventh fold line from the first cut point to the right half circumference along a line oriented rightward at a fifth angle ($\theta_5$) of substantially 32° away from the first cut line;

making an eighth fold line from the first cut point to the fourth cut point; and making a ninth fold line from the second cut point to the third cut point.

2. A method according to claim 1, further including the steps of:

attaching a separate sheet of reinforcing material having a shape of a curvilinear polygon along a first of it's curvilinear segments along said left half circumference of said ovular blank from a point adjacent to said point of termination of said fifth fold line on said circumference to a point lying on said left half circumference between said fifth fold line termination point and said termination point of said fourth fold line on said left half circumference; and attaching the separate sheet along a second of it's curvilinear segments along said right half circumference of said ovular blank from a point adjacent to said termination point on said right half circumference of said sixth fold line to a point lying on said right half circumference between said sixth fold line termination point and said termination point of said seventh fold line on said right half circumference, the separate sheet of material covering a portion of an exterior surface of the ovular blank.

3. The method of claim 2 further including the steps of:

folding said blank along said fourth and said eighth fold lines so that said fourth fold line substantially coincides with said fourth cut line with a triangular planar segment of paperboard between the fourth cut line and the fourth fold line behind a planar portion of paperboard between the first and fourth cut lines and the eighth fold lines;

folding said blank along said seventh and said eighth fold lines so that said seventh fold line substantially coincides with said first cut line with a triangular planar segment of the paperboard between the seventh fold line and the first cut line behind the planar portion of paperboard between the first and fourth cut lines and the eighth fold lines;

folding said blank along said sixth and said ninth fold lines so that said sixth fold line substantially coincides with said second cut line with a triangular planar segment of paperboard between the first cut line and the sixth fold line behind a planar portion of paperboard between the second and third cut lines and the ninth fold line; and folding said blank along said fifth and said ninth fold lines so that said fifth fold line substantially coincides with said third cut line with a triangular planar segment of paperboard between the third cut line and the fifth fold line behind a planar portion of paperboard between the second and third cut lines and the ninth fold line.

4. A method according to claim 1, further including the step of:

securing a separate sheet of reinforcing material of quadrilateral shape to one planar face of said ovular shaped blank to cover two or more of the perimeter lines of the quadrilateral defined by the said first fold line, said second fold line, said eighth fold line and said ninth fold line.

5. The method of claim 2 further including the steps of:

securing the triangular planar segment of paperboard between the seventh fold line and the first cut line and the triangular planar segment of paperboard between the fourth fold line and fourth cut line to the planar portion of paperboard between the first and fourth cut lines and the eighth fold line with the former triangular segment behind the latter, securing the triangular planar segment of paperboard between the first cut line and the sixth fold line, and the triangular planar segment of paperboard between the third cut line and the fifth fold line, one behind the other, to the planar portion of paperboard between second and third cut lines to form a shell having a cavity for capturing the baseball, and having a convex exterior surface, the sheet of reinforcing material cooperating with such convex exterior surface to provide an enclosure for receiving a hand.

6. The method of claim 5, further including the steps of providing:

a tenth fold line along a line in said right half oval beginning on said right half circumference and terminating on said first cut line, with the tenth fold line being oriented leftward at a sixth angle $\theta_6=(180°-\theta_1)$ away from said seventh fold line, where the tenth fold line terminates on said right half circumference at a point that is substantially the same distance from said termination point of said seventh fold line on said right half circumference as is the distance of said termination points on said circumference of said first cut line and said fourth cut line from one another;

folding the paperboard along the seventh and tenth fold lines such that a triangular segment of paperboard between the seventh fold line and the first cut line is behind the triangular segment of paperboard between the fourth cut line and the fourth fold line with the tenth fold line substantially coinciding with the fourth cut line; and securing a planar triangular segment of the paperboard between the tenth fold line and the first cut line to the planar portion of the paperboard between the second, fourth and fifth fold lines.

7. A method according to claim 6 further including the step of:

making an eleventh fold line along a chord in said right half oval along a line oriented at a seventh angle $o_7$ approximately 11° away from the diameter line, where the eleventh fold line terminates at one end on said right half circumference adjacent to said termination points of said sixth fold line and said seventh fold line on said right half circumference, and the eleventh fold line does not intersect the sixth fold line or the seventh fold line within the right half oval.

8. A method according to claim 7, further including the step of:

making a twelfth fold line along a chord in said right half oval oriented at an eight angle $0_8$ approximately 27° away from said diameter line, where the twelfth fold line terminates at one end on said right half circumference at a point adjacent to said termination point of said eleventh fold line that is adjacent to said termination point of said sixth fold line on said right half circumference, and the twelfth fold line does not intersect said eleventh fold line within said right half oval.

9. A method according to claim 8, further including the step of:

making another fold line along a line, beginning on said left half circumference and terminating on said fifth fold line, that is substantially parallel to but spaced apart from said fourth fold line by a distance of at least 3 cm.

10. A hand held shell providing a cavity for catching a baseball fabricated from paperboard comprising:

a first substantially planar, quadrilateral shaped element that is substantially 3 cm. in width and substantially 6 cm. in length;

a second substantially planar element, contiguous with and attached to one of the long sides of the first planar element with the plane of the second planar element intersecting the plane of the first planar element at a first angle ($\phi_1$) of at least 25°;

a third substantially planar element, contiguous with and attached to the second long side of the first planar element with the plane of the third planar element intersecting the plane of the first planar element at a second angle ($\phi_2$) of at least 25°;

a fourth substantially planar, trapezoidal element, contiguous with and attached to one of the short sides of the first planar element, with the plane of the fourth planar element intersecting the plane of the first planar element at a third angle ($\phi_3$) of at least 25°, with the second planar element intersecting and being attached to the fourth planar element along a common edge, and with the third planar element intersecting and being attached to the fourth planar element along a common edge; and a fifth substantially planar, trapezoidal element, contiguous with and attached to the second short side of the first planar element, with the plane of the fifth planar element intersecting the plane of the first planar element at a fourth angle ($\phi_4$) of at least 10°, with the second planar element intersecting and being attached to the fifth planar element along a common edge, and with the third planar element intersecting and being attached to the fifth planar element along a common edge forming a paperboard shell having a concave interior surface and a convex exterior surface.

11. The shell according to claim 10 having a top and a bottom and further including a separate sheet of reinforcing material in the shape of a curvilinear polygon being attached to an exposed edge of the second planar element along a first of its curvilinear segments, and covering a lower portion of the exterior convex surface of the shell with a second of its curvilinear segments touching the convex surface and being attached to an exposed edge of the third planar element along a third of its curvilinear segments, the first, second and third curvilinear segments of the polygon of reinforcing material being contiguous whereby the reinforcing sheet provides, in combination with the convex exterior surface of the shell, an enclosure suitable for snugly receiving a human hand opening at the bottom of the shell.

12. The shell of claim 10 being formed from a single sheet of paperboard, and further including a sheet of reinforcing material secured to a surface of the shell substantially covering the first planar element.

13. A baseball glove according to claim 12, further including a separate sheet of reinforcing material in the shape of a curvilinear polygon located on the exterior convex surface of the shell, attached to one portion of the perimeter of said shell along a first of its curvilinear segments and attached to a second portion of the perimeter of said shell approximately diametrically opposite the first portion along a second of its curvilinear segments thereby defining with the convex surface an enclosure suitable for snugly receiving a human hand.

14. The baseball glove of claim 11 wherein a hole is defined through the reinforcing sheet located for receiving an index finger of the human hand when same is received within the enclosure.

* * * * *